US010493348B2

(12) United States Patent
Song

(10) Patent No.: US 10,493,348 B2
(45) Date of Patent: Dec. 3, 2019

(54) ELECTRONIC SCORING SYSTEM WITH IMPACT ZONE LOCATOR

(71) Applicant: Jin Song, Saratoga, CA (US)

(72) Inventor: Jin Song, Saratoga, CA (US)

( * ) Notice: Subject to any disclaimer, the term of this patent is extended or adjusted under 35 U.S.C. 154(b) by 0 days.

(21) Appl. No.: 15/998,050

(22) Filed: Jun. 18, 2018

(65) Prior Publication Data

US 2019/0134486 A1 May 9, 2019

Related U.S. Application Data

(60) Provisional application No. 62/523,078, filed on Jun. 21, 2017.

(51) Int. Cl.

| | |
|---|---|
| ***A63B 71/06*** | (2006.01) |
| ***A41D 13/05*** | (2006.01) |
| ***A63B 71/12*** | (2006.01) |

(52) U.S. Cl.

CPC ..... *A63B 71/06* (2013.01); *A41D 13/0518* (2013.01); *A63B 71/0622* (2013.01); *A63B 71/12* (2013.01); *A63B 2225/50* (2013.01)

(58) Field of Classification Search

None

See application file for complete search history.

(56) References Cited

U.S. PATENT DOCUMENTS

| | | | | |
|---|---|---|---|---|
| 8,021,281 | B2 * | 9/2011 | Forsell | A63B 69/004 463/47.1 |
| 9,056,234 | B2 * | 6/2015 | Pysden | A63B 69/004 |
| 9,427,623 | B2 * | 8/2016 | Gennario, Jr. | A42B 3/0433 |
| 2004/0009851 | A1 * | 1/2004 | Lovison | A63B 69/004 482/84 |
| 2006/0101988 | A1 * | 5/2006 | Aldridge | A63B 69/004 84/733 |
| 2009/0235761 | A1 * | 9/2009 | Song | A63B 69/004 73/862.59 |
| 2014/0343701 | A1 * | 11/2014 | Song | A63B 71/06 700/92 |

* cited by examiner

*Primary Examiner* — Ronald Laneau

(74) *Attorney, Agent, or Firm* — Dan de la Rose

(57) ABSTRACT

The present invention provides for a scoring system for martial arts with a plurality of zonal areas with a plurality of sensors for determining the location of a strike, and a plurality of proximity sensors distinguish incidental contact from a valid point.

18 Claims, 1 Drawing Sheet

ELECTRONIC SCORING SYSTEM WITH IMPACT ZONE LOCATOR

RELATED APPLICATION

This application is based on and claims priority from the provisional application entitled "ELECTRONIC SCORING SYSTEM" with U.S. Ser. No. 62/523,078 filed on Jun. 21, 2017.

BACKGROUND OF THE INVENTION

Field of the Invention

This invention relates to a stand-alone scoring system and more specifically, to a scoring system for contact sports such as karate, taekwondo and other martial arts.

Description of the Related Art

There are various prior art references showing sensors and scoring systems but such systems are limited to impact or movement sensor. In addition, they cannot distinguish between legitimate points using proper techniques and accidental strikes using improper techniques. Furthermore, the prior art does not provide for a stand-alone scoring using indicators such as lights, sounds and other methods that are worn by the participants.

SUMMARY OF THE INVENTION

In one embodiment, the present invention provides a scoring system comprising: at least one chest protector comprising a first sensor and at least one transmitter; at least one helmet comprising at least one receiver and at least one indicator, the indicator is selected from a group consisting essentially of lights, sound, and combinations thereof; and a foot gear and/or hand gear designed to make impact with the chest protector thereby activating the sensor and the impact is then read by the transmitter and sent to the receiver on the helmet which activates the indicator to show that a body shot was scored by a strike such as a kick or a punch.

In another embodiment, the sensor is selected from a group consisting essentially of impact sensor, proximity sensor, magnetic proximity sensor, metal detector proximity sensor and combinations thereof.

In yet another embodiment, the proximity sensor functions to distinguish incidental contact from a valid point. In still another embodiment, the indicator comprises a plurality of lights. In still yet another embodiment, each of the lights is a different color, each color indicating a particular message.

In a further embodiment, the foot gear impacts the helmet thereby activating a particular colored light on said indicator to show that a head shot was scored by a kick. In another further embodiment, the foot gear impacts the chest protector which activates the built in transmitter to send a message to the receiver and upon receiving the message a certain number of lights are activated by the receiver to indicate the number of points. In still a further embodiment, the foot gear impacts the helmet and a certain number of lights are activated to indicate the number of points.

In yet a further embodiment, the proximity sensor is selected from a group consisting essentially of a magnetic flux detector, a metal detector and combinations thereof.

In still yet a further embodiment, the foot gear has a trigger, and the trigger is selected from a group consisting essentially of plurality of magnets, metal and combinations thereof. In another embodiment, the system is a stand-alone system.

In another embodiment, the system further comprises at least one pair of gloves designed to make impact with the chest protector thereby activating the sensor and the impact is then read by the transmitter and sent to the receiver on the helmet which activates the light on the indicator to show that a body shot was scored by a punch.

In yet another embodiment, the gloves has a trigger, and the trigger is selected from a group consisting essentially of plurality of magnets, metal and combinations thereof.

In still another embodiment, the system further comprises a second chest protector with at least one sensor and at least one transmitter, a second helmet comprising at least one receiver and at least one indicator, and the indicator comprising at least one light, and a second foot gear.

In still yet another embodiment, the system further comprises a second pair of gloves, said second pair of gloves have a trigger, and the trigger is selected from a group consisting essentially of plurality of magnets, metal and combinations thereof.

In a further embodiment, the impact sensor is selected from a group consisting essentially of accelerometer, piezoelectric device and combinations thereof. In another further embodiment, the foot gear is selected from a group consisting essentially of socks, bootie and an article of clothing.

In yet another further embodiment, the system further comprises a power source, and the power source is situated in the chest protector, and the power source is selected from a group consisting essentially of batteries, rechargeable batteries and combinations thereof. In still another further embodiment, the indicator comprises at least one light.

In another embodiment, one light has different colors, each color indicating a particular message. In a further embodiment, the indicator comprises a plurality of sounds, each sound indicating a particular message. In another further embodiment, the indicator combines the use of sounds and colored light, each sound and each color indicating a particular message.

In a further embodiment, the sensor is divided into at least two or three or more segments designated particular areas and the areas allow the determination of the location of an impact on the chest protector and/or helmet.

In another further embodiment, the present invention provides for a scoring system comprising: at least two chest protectors, each chest protector comprises a first sensor and at least one transmitter; at least two helmets, each helmet comprises at least one receiver and at least one point scoring indicator; at least two pairs of foot gear, each foot gear is designed to make impact with an opponent's chest protector thereby activating the sensor and the impact is then read by the transmitter and sent to the receiver on the helmet which activates the indicator to show that a body shot was scored by a kick; and at least two pair of gloves, each pair of gloves is designed to make impact with the opponent's chest protector thereby activating the sensor and the impact is then read by the transmitter and sent to the receiver on the helmet which activates the indicator to show that a body shot was scored by a punch, and the chest protectors, helmets, foot gear and gloves are designed to be worn by opponents for sparring and scoring.

In another embodiment, the present invention provides for a scoring system comprising: at least one chest protector comprising a plurality of sensors and at least one transmitter, said chest protector comprises a plurality of zonal areas, each zonal area having at least one sensor; at least one helmet comprising a plurality of sensors, said helmet comprises a plurality of zonal areas, each zonal area having at least one sensor; at least one receiver; and a foot gear designed to make impact with said chest protector thereby activating said sensor at a particular zonal area of said chest protector and the impact is then read by said transmitter and sent to said receiver which shows that a body shot was scored by a kick and the location of the impact.

In yet another embodiment, the sensor is selected from a group consisting essentially of impact sensor, proximity sensor, magnetic proximity sensor, metal detector proximity sensor and combinations thereof. In still another embodiment, the proximity sensor functions to distinguish incidental contact from a valid point.

In a further embodiment, the foot gear is designed to make impact with said helmet thereby activating said sensor at a particular zonal area of said helmet and the impact is then read by said transmitter and sent to said receiver which shows that a head shot was scored by a kick and the location of the impact.

In yet a further embodiment, the helmet houses said receiver and comprises at least one indicator, said indicator is selected from a group consisting essentially of lights, sound, and combinations thereof. In still a further embodiment, the receiver is connected to a computer and the computer shows where the impact was made. In another embodiment, the computer is connected to at least one display monitor. In a further embodiment, the proximity sensor is selected from a group consisting essentially of a magnetic flux detector, a metal detector and combinations thereof.

In another further embodiment, the system further comprises at least one pair of gloves designed to make impact with said chest protector thereby activating said sensor and the impact is then read by said transmitter and sent to said receiver which shows that a body shot was scored by a punch. In yet a further embodiment, the foot gear and the gloves have triggers, and the triggers are selected from a group consisting essentially of plurality of magnets, metal and combinations thereof.

In still a further embodiment, the system further comprises a second pair of gloves and a second chest protector with a plurality of sensors and at least one transmitter, said chest protector comprises a plurality of zonal areas, each zonal area having at least one sensor; a second receiver; and a second helmet comprising a plurality of sensors, said helmet comprises a plurality of zonal areas, each zonal area having at least one sensor, said second pair of gloves has a trigger, said trigger is selected from a group consisting essentially of plurality of magnets, metals and combinations thereof. In another embodiment, the foot gear is selected from a group consisting essentially of socks, bootie and an article of clothing.

In a further embodiment, the present invention relates to a scoring system comprising: at least one chest protector comprising a plurality of sensors and at least one transmitter, said chest protector comprises a plurality of zonal areas, each zonal area having at least one sensor; at least one receiver; and a foot gear designed to make impact with said chest protector thereby activating said sensor at a particular zonal area of said chest protector and the impact is then read by said transmitter and sent to said receiver which shows that a body shot was scored by a kick and the location of the impact.

In another further embodiment, the system further comprises at least one helmet comprising a plurality of sensors, said helmet comprises a plurality of zonal areas, each zonal area having at least one sensor. In another embodiment, the foot gear is designed to make impact with said helmet thereby activating said sensor at a particular zonal area of said helmet and the impact is then read by said transmitter and sent to said receiver which shows that a head shot was scored by a kick and the location of the impact.

In a further embodiment, the sensor is selected from a group consisting essentially of impact sensor, proximity sensor, magnetic proximity sensor, metal detector proximity sensor and combinations thereof. In another further embodiment, the proximity sensor functions to distinguish incidental contact from a valid point.

In a further embodiment, the system further comprises at least one pair of gloves designed to make impact with said chest protector thereby activating said sensor and the impact is then read by said transmitter and sent to said receiver which shows that a body shot was scored by a punch and the location of impact. In another embodiment, the system is adaptable with smart devices selected from a group consisting essentially of phones, pads and computers. In a further embodiment, the helmet houses said receiver and comprises at least one indicator, said indicator is selected from a group consisting essentially of lights, sound, and combinations thereof.

BRIEF DESCRIPTION OF THE DRAWINGS

The accompanying drawings are included to provide a further understanding of the present invention. These drawings are incorporated in and constitute a part of this specification, illustrate one or more embodiments of the present invention and together with the description, serve to explain the principles of the present invention.

Among those benefits and improvements that have been disclosed, other objects and advantages of this invention will become apparent from the following description taken in conjunction with the accompanying drawings. The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention that may be embodied in various forms. The figures are not necessarily to scale, some features may be exaggerated to show details of particular components. Therefore, specific structural and functional details disclosed herein are not to be interpreted as limiting, but merely as a basis for the claims and as a representative basis for teaching one skilled in the art to variously employ the present invention.

Figure 1:
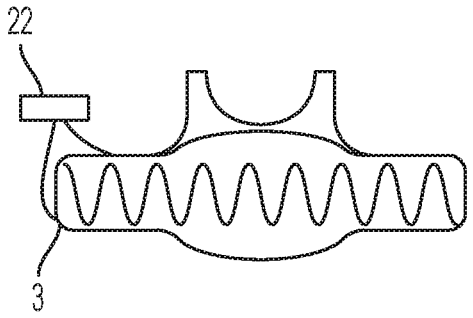
FIG. 1 is a front perspective view of one of the embodiments of the chest protectors of the present invention having contiguous sensors.

FIG. 1 represents one embodiment of the present invention with a single contiguous proximity sensor channel. A contact in any of the area is picked up as a hit to the torso area and collected by the electronics 22. This single contiguous system can be used with a computer and display or can be a stand-alone system as discussed below.

Figure 2:
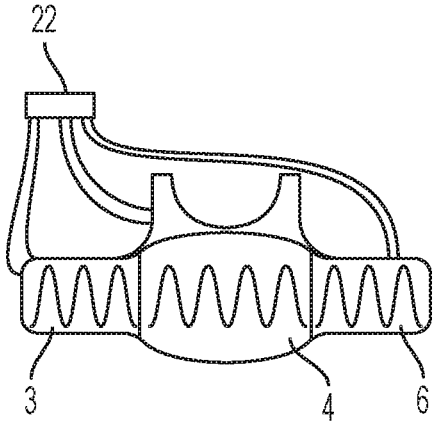
FIG. 2 is a front perspective view of another embodiment of the chest protectors of the present invention having a sensor with multiple sections and segments for detecting location of impact.

FIG. 2 shows another embodiment of the present invention where a single sensor 3 is divided into three separate segments: area 3*a* covers left, area 4 covers middle, and area 5 covers right. In another embodiment, the single sensor may be divided into two or more segments with no limitation on the number of segments. The segments or sections forming the areas allow the system to identify the location of the contact or impact. A contact area can be identified based on the sensor triggered by the contacting technique. The area can be further identified as the middle of the three when two sensors are triggered. For example, if sensor in area 3 and area 4 is triggered simultaneously, the contact area is determined to be in between the left and middle. This multiple segments or section system can be used with a computer and display or can be a stand-alone system as discussed below.

Figure 3:
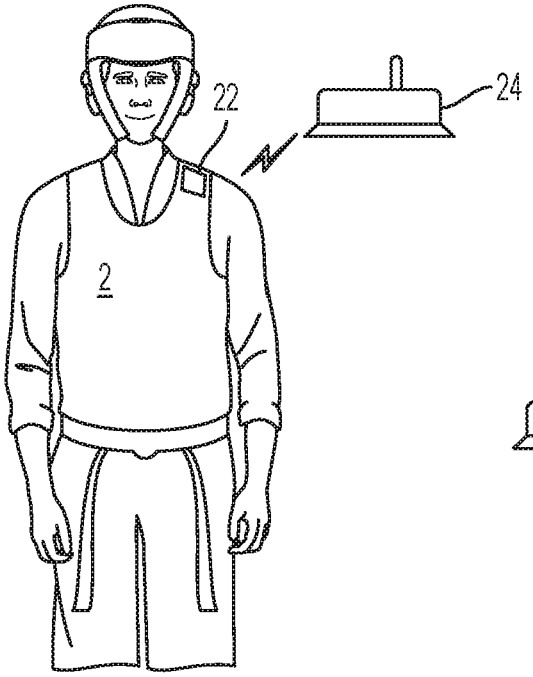
FIG. 3 is a front view showing a scoring system from the prior art using a computer and a display screen.

FIG. 3 depicts the prior art which uses impact sensors with computers and/or displays. There are sensors 2 which pick up contact or impact and have electronics 22, which sends the information wirelessly to a receiver 24. The receiver 24 forwards the data to a computer that displays the results. The prior art did not disclose the use of proximity sensors and combinations of sensors or the use of a stand-alone system as discussed below.

Figure 4:
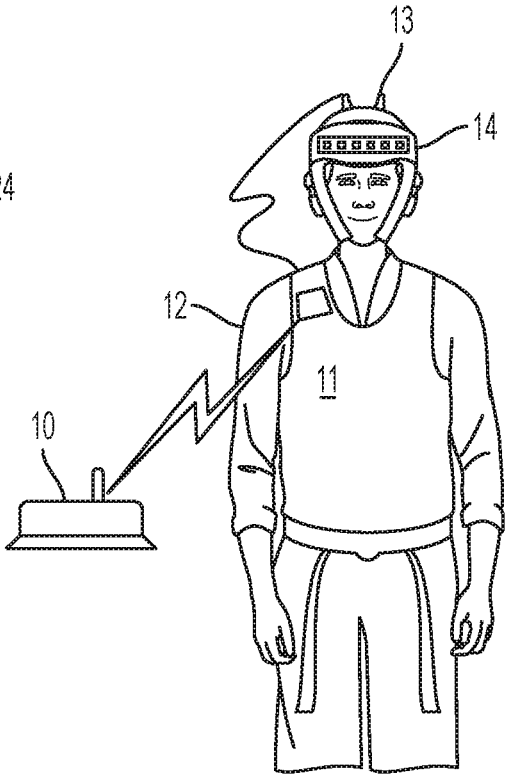
FIG. 4 is a front view of the stand-alone system of the present invention.

FIG. 4 illustrates a stand-alone system. A sensor 11 picked ups impact or contact and has electronics 12. The electronics 12 in the sensor 11 sends the information to the receiver 13, which is embedded in the head gear or helmet. The information is displayed locally by some visible means as shown by indicator 14. In one embodiment, the indicator 14 can be multiple colored Light Emitting Diodes (LEDs). Each color could represent different information: for example, red indicates system fault, green indicates body contact that meets the point criteria, blue indicates head contact, and yellow indicates penalty condition. An optional control box 10 links to the electronics 12, and/or a control 13. As stated above, the indicator can also use sound or the combination of lights and sound.

Numerous modifications and variations of the present invention are possible in light of the above teachings. It is therefore to be understood that within the scope of the attendant claims attached hereto, this invention may be practiced otherwise than as specifically disclosed herein.

What is claimed is:

1. A scoring system comprising:

at least one chest protector comprising a plurality of sensors and at least one transmitter, said chest protector comprises a plurality of zonal areas, each zonal area having at least one sensor;

at least one helmet comprising a plurality of sensors, said helmet comprises a plurality of zonal areas, each zonal area having at least one sensor;

at least one receiver; and a foot gear designed to make impact with said chest protector thereby activating said sensor at a particular zonal area of said chest protector and the impact is then read by said transmitter and sent to said receiver which shows that a body shot was scored by a kick and the location of the impact, said foot gear is designed to make impact with said helmet thereby activating said sensor at a particular zonal area of said helmet and the impact is then read by said transmitter and sent to said receiver which shows that a head shot was scored by a kick and the location of the impact.

2. The system of claim 1 wherein said sensor is selected from a group consisting essentially of impact sensor, proximity sensor, magnetic proximity sensor, metal detector proximity sensor and combinations thereof.

3. The system of claim 2 wherein said proximity sensor functions to distinguish incidental contact from a valid point.

4. The system of claim 1 wherein said helmet houses said receiver and comprises at least one indicator, said indicator is selected from a group consisting essentially of lights, sound, and combinations thereof.

5. The system of claim 1 wherein said receiver is connected to a computer and the computer shows where the impact was made.

6. The system of claim 5 wherein the computer is connected to at least one display monitor.

7. The system of claim 2 wherein said proximity sensor is selected from a group consisting essentially of a magnetic flux detector, a metal detector and combinations thereof.

8. The system of claim 1 further comprises at least one pair of gloves designed to make impact with said chest protector thereby activating said sensor and the impact is then read by said transmitter and sent to said receiver which shows that a body shot was scored by a punch.

9. The system of claim 8 wherein said foot gear and said gloves have triggers, said triggers are selected from a group consisting essentially of plurality of magnets, metal and combinations thereof.

10. The system of claim 1 further comprises a second pair of gloves and a second chest protector with a plurality of sensors and at least one transmitter, said chest protector comprises a plurality of zonal areas, each zonal area having at least one sensor; a second receiver; and a second helmet comprising a plurality of sensors, said helmet comprises a plurality of zonal areas, each zonal area having at least one sensor, said second pair of gloves has a trigger, said trigger is selected from a group consisting essentially of plurality of magnets, metals and combinations thereof.

11. The system of claim 1 wherein said foot gear is selected from a group consisting essentially of socks, bootie and an article of clothing.

12. A scoring system comprising:

at least one chest protector comprising a plurality of sensors and at least one transmitter, said chest protector comprises a plurality of zonal areas, each zonal area having at least one sensor;

at least one receiver; and a foot gear designed to make impact with said chest protector thereby activating said sensor at a particular zonal area of said chest protector and the impact is then read by said transmitter and sent to said receiver which shows that a body shot was scored by a kick and the location of the impact, said foot gear is designed to make impact with said helmet thereby activating said sensor at a particular zonal area of said helmet and the impact is then read by said transmitter and sent to said receiver which shows that a head shot was scored by a kick and the location of the impact.

13. The system of claim 12 further comprising at least one helmet comprising a plurality of sensors, said helmet comprises a plurality of zonal areas, each zonal area having at least one sensor.

14. The system of claim 12 wherein said sensor is selected from a group consisting essentially of impact sensor, proximity sensor, magnetic proximity sensor, metal detector proximity sensor and combinations thereof.

15. The system of claim 14 wherein said proximity sensor functions to distinguish incidental contact from a valid point.

16. The system of claim 12 further comprises at least one pair of gloves designed to make impact with said chest protector thereby activating said sensor and the impact is then read by said transmitter and sent to said receiver which shows that a body shot was scored by a punch and the location of impact.

17. The system of claim 12 wherein said system is adaptable with smart devices selected from a group consisting essentially of phones, pads and computers.

18. The system of claim 13 wherein said helmet houses said receiver and comprises at least one indicator, said indicator is selected from a group consisting essentially of lights, sound, and combinations thereof.

* * * * *